US008857526B2

(12) United States Patent
Erkol et al.

(10) Patent No.: US 8,857,526 B2
(45) Date of Patent: Oct. 14, 2014

(54) MECHANICALLY DEPLOYABLE WELL ISOLATION MECHANISM

(75) Inventors: Zafer Erkol, Sugar Land, TX (US); Zheng Rong Xu, Sugar Land, TX (US); Ian Crossland, Richmond, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 549 days.

(21) Appl. No.: 12/767,111

(22) Filed: Apr. 26, 2010

(65) Prior Publication Data

US 2011/0259611 A1 Oct. 27, 2011

(51) Int. Cl.

| | |
|---|---|
| ***E21B 23/06*** | (2006.01) |
| ***E21B 33/12*** | (2006.01) |
| ***E21B 33/122*** | (2006.01) |

(52) U.S. Cl.

CPC ..... *E21B 33/1208* (2013.01); *E21B 33/122* (2013.01)

USPC ..... 166/387; 166/118

(58) Field of Classification Search

USPC ..... 166/381, 387, 118, 191

See application file for complete search history.

(56) References Cited

U.S. PATENT DOCUMENTS

| | | | | |
|---|---|---|---|---|
| 3,385,367 | A * | 5/1968 | Kollsman | 166/191 |
| 7,703,539 | B2 * | 4/2010 | Levy | 166/378 |
| 2004/0055758 | A1 * | 3/2004 | Brezinski et al. | 166/384 |
| 2007/0221387 | A1 * | 9/2007 | Levy | 166/387 |
| 2007/0240877 | A1 * | 10/2007 | O'Malley et al. | 166/179 |
| 2008/0023205 | A1 | 1/2008 | Craster et al. | |
| 2008/0042362 | A1 | 2/2008 | Wood | |
| 2008/0087431 | A1 | 4/2008 | Willauer | |
| 2008/0296023 | A1 | 12/2008 | Willauer | |
| 2008/0302526 | A1 * | 12/2008 | Eriksson et al. | 166/179 |
| 2010/0307773 | A1 | 12/2010 | Tinnen et al. | |

FOREIGN PATENT DOCUMENTS

WO 2010/045077 A2 4/2010

* cited by examiner

*Primary Examiner* — Doug Hutton, Jr.
*Assistant Examiner* — Catherine Loikith
(74) *Attorney, Agent, or Firm* — Michael Flynn; Timothy Curington; Robin Nava

(57) ABSTRACT

A mechanism configured for mechanical self-deployment in a well. The mechanism may be primarily an open or closed-cell polymer foam positioned downhole in a pre-compressed state. Subsequently, the mechanism may be released from a housing for self-deployment and engagement with a wall of the well. Such a mechanism may serve the conventional purpose of a downhole packer or other similar restriction devices. Additionally, due to the self-deploying nature of the device, multiple such devices may be linked in series based upon user-determined criteria at the time of application. Thus, a reduction in the number of trips in the well may generally be realized.

23 Claims, 5 Drawing Sheets

MECHANICALLY DEPLOYABLE WELL ISOLATION MECHANISM

FIELD

Embodiments described relate to mechanically deployable structures for use downhole in a well. In particular, deployable structures or mechanisms are disclosed which are configured to provide a sealing engagement relative the well. More specifically, mechanisms as detailed herein may be employed in lieu of conventional downhole packers. Embodiments described herein achieve the noted sealing deployment without the requirement of fluid inflation.

BACKGROUND

The statements made herein provide background information related to the present disclosure and may or may not constitute prior art.

Exploring, drilling and completing hydrocarbon and other wells are generally complicated, time consuming, and ultimately very expensive endeavors. As a result, over the years, a significant amount of added emphasis has been placed on well monitoring and maintenance. Once more, perhaps even more emphasis has been directed at initial well architecture and design. All in all, careful attention to design, monitoring and maintenance may help maximize production and extend well life. Thus, a substantial return on the investment in the completed well may be better ensured.

In the case of well monitoring and logging, mostly minimally-invasive applications may be utilized which provide temperature, pressure and other production related information. By contrast, well design, completion and subsequent maintenance, may involve a host of more direct interventional applications. For example, perforations may be induced in the wall of the well, debris or tools and equipment removed, etc. In some cases, the well may even be designed or modified such that entire downhole regions are isolated or closed off from production. Such is often the case where an otherwise productive well region is prone to produce water or other undesirable fluid that tends to hamper hydrocarbon recovery.

Closing off well regions as noted above is generally achieved by way of setting one or more inflatable packers. Such packers may be set at downhole locations and serve to seal off certain downhole regions from other productive regions. Delivering, deploying and setting packers for isolation may be achieved by way of coiled tubing, or other conventional line delivery application. The application may be directed from the oilfield surface and involve a significant amount of manpower and equipment. Indeed, the application may be fairly sophisticated, given the amount of precision involved in packer positioning and inflation. As noted further below, proper packer inflation, in particular may be quite challenging, given the high and variable temperature and pressure extremes often present downhole which can affect fluid inflation.

Unfortunately, isolation of a downhole region generally requires positioning and deployment of at least two packers. For example, where a perforated region of a well is to be isolated, packers may be deployed at either side of downhole perforations. This is due to the fact that it is unlikely that the perforated downhole region is of such a limited size so as to be fully occluded by deployment of a single conventionally sized packer (i.e. generally less than about two feet in length). As a result, cutting off the noted downhole region requires multiple packer delivery applications, thus increasing expenses associated with the manpower, equipment and, perhaps most importantly, time, are significantly increased.

In addition to the expenses associated with packer delivery and deployment applications, the effectiveness of packer isolation itself is often less than desirable. For example, once a well region is identified for isolation, such as where water production is detected, the isolation is generally sought for the remaining life of the well. As a practical matter, this means that packer isolation of the region may be desirable for up to twenty years or more. However, for the reasons described below, it is unlikely that packer isolation of such a region would be reliable for such durations.

Changing well conditions may have a significant impact on proper packer inflation and sealing off of the well region. More specifically, as pressure and temperature rise, the fluid employed for packer inflation, as well as the packer material itself, may tend to be more expansive. In one sense, this may promote sealing of the packer at the well wall. However, this may also lead to bursting of the packer, complete failure of the isolation, and even the undesirable introduction of packer inflation fluid to the downhole environment. Alternatively, as pressures and temperatures drop, such fluid and materials may contract. Thus, a once properly sealing packer may ultimately lose its seal and fail to provide the desired isolation. Once more, fairly dramatic variability in pressure and temperature are not uncommon to the downhole environment. As such, it is not uncommon for a properly set packer to later fail due to bursting or contraction as a result of the dynamic downhole conditions.

Attempts have been made to address the dynamic condition of downhole pressure swings. Indeed, a whole host of pressure compensation tools and techniques have been developed and incorporated into many state of the art packer assemblies. Unfortunately, such techniques substantially fail to account for downhole temperature swings which may play just as large a role in packer failure. Furthermore, such techniques fail to address expenses associated with the requirement for multiple packer delivery applications over the course of isolating a single downhole region.

Indeed, each delivery application itself faces its own set of challenges. These may include the possibility of premature inflation or other hazards associated with the deployment of the packer via fluid means. Nevertheless, as a practical matter, current techniques for isolation of single downhole well region are substantially limited to the employment of multiple packer delivery applications involving such fluid inflation.

SUMMARY

An assembly is provided for downhole isolation of a region of a well. The assembly includes a pre-compressed material device configured for mechanical expansion at a location in the well. Such expansion may achieve a seal, similar to a packer. The assembly also includes a retention housing for accommodating the device in advance of delivery thereof at the noted location.

DETAILED DESCRIPTION

Embodiments herein are described with reference to downhole applications employing packer mechanisms. For example, these embodiments focus on the use of mechanically deployable mechanisms to serve as packers for isolating certain downhole regions of a well. However, a variety of alternative applications may employ such mechanisms, such as choking particular downhole production regions. Regardless, embodiments of the deployable mechanisms detailed herein rely primarily on mechanical characteristics for deployment. Thus, sole reliance on fluid inflation for deployment may be avoided. As such, the reliability of deployment and maintenance thereof may be enhanced.

Figure 1A:
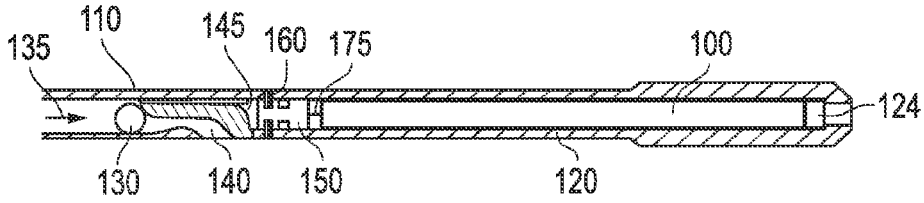
FIG. 1A is a side cross-sectional view of an embodiment of a mechanically deployable well isolation mechanism and delivery assembly therefor.
Figure 1B:
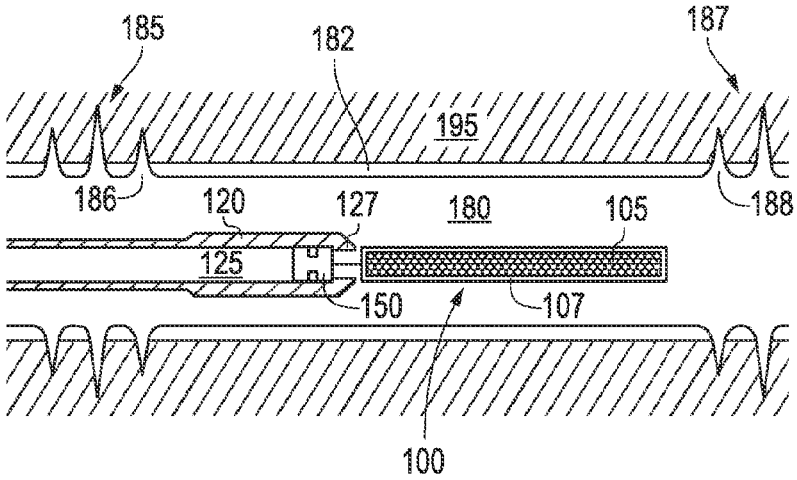
FIG. 1B is a side cross-sectional view of the mechanism and assembly of FIG. 1A at a delivery location in a well for deployment thereat.
Figure 1C:
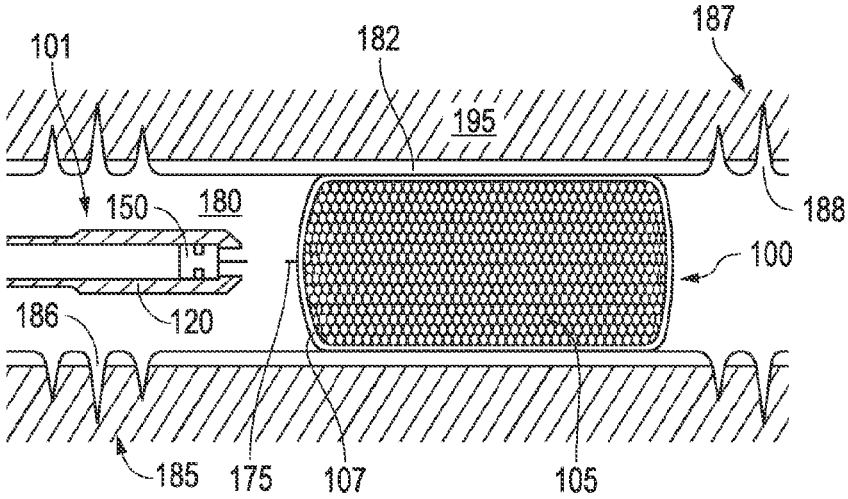
FIG. 1C is a side cross-sectional view of the mechanism of FIG. 1B deployed within the well at the location.

Referring now to FIG. 1A, a side cross-sectional view of an embodiment of a mechanically deployable well isolation mechanism 100 is shown. The mechanism 100 is retained within the housing 120 of a delivery assembly 101 which may also include a specially configured end of a coiled tubing 110 as described further below. As also detailed below, the entire assembly 101 may be advanced to a downhole location in a well 180, where the mechanism 100 may be deployed from the housing 120 as depicted in FIG. 1B. Subsequently, as depicted in FIG. 1C, the mechanism 100 may mechanically expand without any significant amount of fluid inflation as directed from surface (e.g. through the coiled tubing 110). Thus, in a sense, the mechanism 100 may be thought of as 'self-deployable'.

Continuing with reference to FIGS. 1A & 1B, the deployment of the mechanism 100 from the housing 120 may be initiated by a conventional 'ball-drop' technique. That is, as shown, once the assembly 101 is positioned, a ballistic 130 in the form of an appropriately sized stainless steel ball, may be inserted into the coiled tubing 110 from surface (e.g. see FIG. 2). The ballistic 130 may follow a pumped fluid flow (see arrow 135) through the interior of the tubing 110 until, as a matter of size constraints, it blocks a circulation channel 140 adjacent the housing 120. Once such blockage of the circulation channel 140 is achieved, the fluid flow 135 may be forced through a smaller extrusion channel 145. Building fluid pressure through the extrusion channel 145 may act upon a piston 150 immediately adjacent the mechanism 100. Indeed, as shown in FIG. 1B, this pressure may build to such an extent that the retaining capacity of shear pins 160 and a protective plug 124 are overcome, thereby allowing the piston 150 and mechanism 100 to move downhole for extrusion of the mechanism 100 from the housing 120.

Continuing with reference to FIG. 1B, the housing 120 and mechanism 100 are shown at a location in the well 180 between separate production regions 185, 187. The well 180 is defined by a casing 182 with perforations 186, 188 therethrough at each of the production regions 185, 187. Thus, well communication with the surrounding formation 195 may be provided. However, this communication may be affected by the delivery of the mechanism 100 at the depicted location between the regions 185, 187. Indeed, such delivery may close off or isolate the more downhole region 187 from production (see FIGS. 1C & 2).

Continuing with reference to FIG. 1B, the building pressure in the extrusion channel 145 of FIG. 1A may force the piston 150 through the housing channel 125, thereby extruding the physically compressible and expandable mechanism 100 from the housing 120 as indicated. However, unlike the mechanism 100, the piston 150 is of stainless steel or other suitably rigid material. Thus, a diameter restriction 127 at the end of the housing 120 may serve to retain the piston 150 even as the mechanism 100 is extruded therefrom.

The mechanism 100 itself is shown in a cross-sectional fashion in FIGS. 1B and 1C, revealing a pre-compressed matrix material 105 encapsulated by an expandable bladder 107. As is apparent in FIG. 1C, the matrix material 105 may be configured for mechanical self-expansion upon release from the housing 120, whereas the bladder 107 may allow for such expansion and provide a sealing engagement with the well wall (i.e. at the casing 182).

The expanded matrix material 105 of FIG. 1C may be a pre-compressed foam or other suitably expansive structure as noted above and detailed further below. Thus, the mechanism 100 may display an expansion ratio or degree of expansion suitable for forcibly sealing the bladder 107 against the casing 182 as noted above. So, for example, a 1-3 inch outer diameter mechanism 100 may readily expand and conform to a 9-12 diameter casing 182 creating a sealing engagement therewith. Once more, the force of the engagement may be more than adequate for both sealing and isolating as well as physically holding the mechanism 100 in place. Indeed, even though a physical line 175 is provided between the piston 150 and mechanism 100, as the housing 120 and piston 150 are pulled back uphole, the line 175 is broken and the mechanism 100 remains in place. In one embodiment, the outer surface of the mechanism 100 is even covered with a friction enhancing substance such as solid metallic particles so as to further the anchoring in place of the deployed mechanism 100 as depicted.

In the embodiment of FIGS. 1A-1C, the presence of a fluid impermeable bladder 107 allows for the use of open cell foam to serve as the matrix material 105. However, closed cell foams may also be employed. Indeed, in one embodiment, the entire mechanism is made up of a closed cell foam without the use of a protective bladder. Regardless, open or closed cell foams employed may be of conventional plastic, reinforced polymers and/or elastomers. Furthermore, a variety of nanocomposites and fibers may be incorporated into the matrix material 105.

Figure 2:
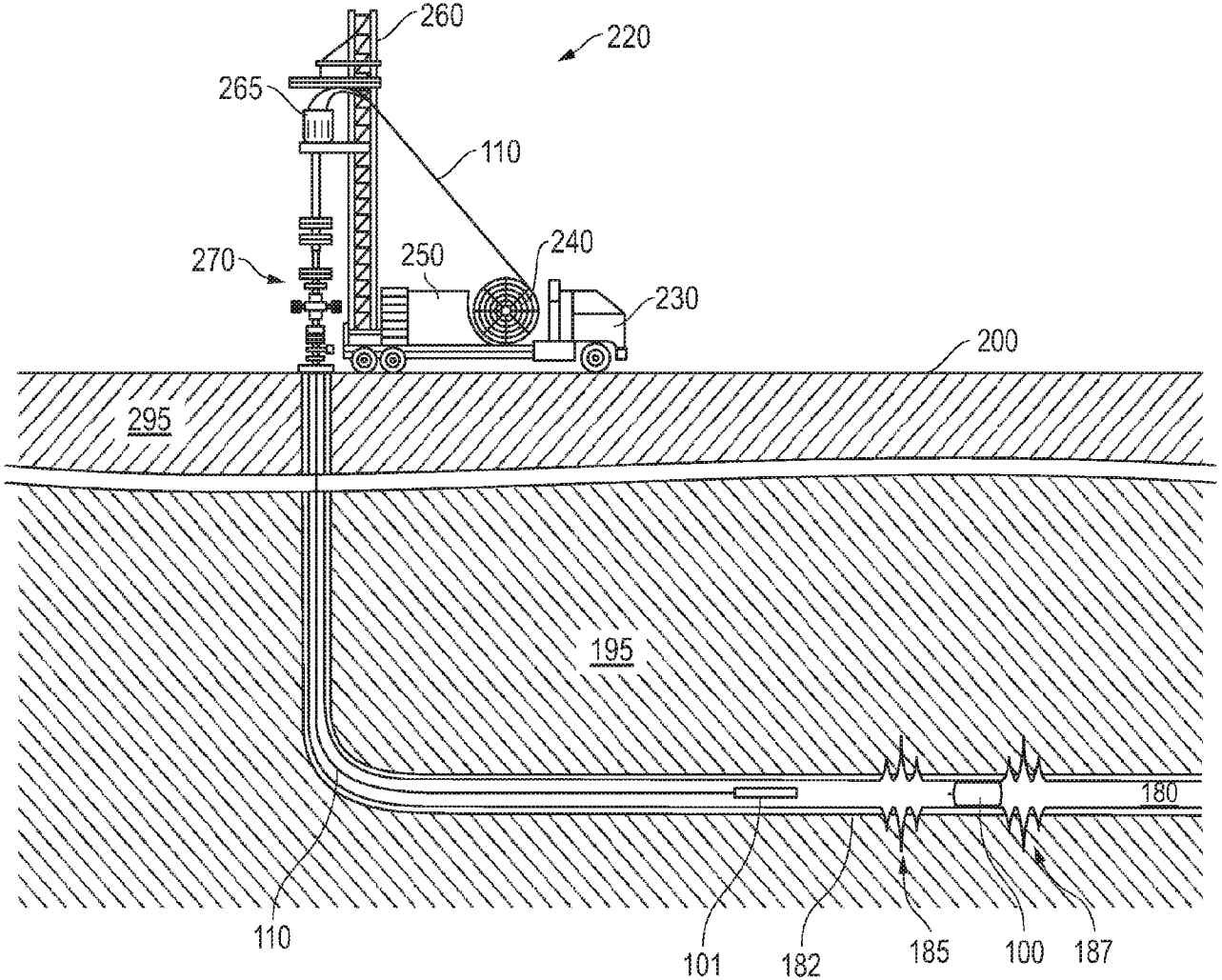
FIG. 2 is an overview depiction of an oilfield accommodating the well of FIGS. 1B and 1C thereat with the mechanism and assembly disposed therein.

Referring now to FIG. 2, an overview of an oilfield 200 is shown which accommodates the well 180 of FIGS. 1B and 1C. In the embodiment shown, the mechanically deployable mechanism 100 has already been sealably secured at the location between the noted downhole regions 185, 187. Thus, the more downhole region 187 is isolated from production.

Delivery of the mechanism 100 is achieved by way of coiled tubing 110. However, in other embodiments, a wireline cable, drill pipe, jointed pipe or other conventional delivery line may be employed to position the mechanism 100 downhole. In fact, in one embodiment, a non-communicative slickline may be employed which utilizes a time based release for deployment of the mechanism 100.

Continuing with reference to FIG. 2, the coiled tubing application is run with a variety of surface equipment 220 provided to the well site. Namely, a mobile coiled tubing truck 230 is positioned adjacent the well 180. The truck 230 accommodates a reel 240 of the coiled tubing 110 and a control unit 250 for directing the application. Additionally, in the embodiment shown, a mobile rig 260 is provided for supporting a gooseneck injector 265. The injector 265 is responsible for forcing the tubing 110 through valve and pressure control equipment 270, often referred to as a 'Christmas Tree'. Indeed, the injector 265 drives the coiled tubing 110 with enough force to traverse potentially thousands of feet and various formation layers 295, 195 in order to deliver the mechanism 100 to the depicted location.

Subsequently, the coiled tubing 110 and delivery assembly 101 may be withdrawn, leaving the mechanically deployable well isolation mechanism 100 in place to serve as a conventional packer and isolate a downhole region 187. Furthermore, as detailed above, such delivery and deployment of the mechanism 100 is achieved without the requirement of any significant inflation media. Thus, deployment of the mechanism 100 is not dependent upon proper management of such inflation media or associated equipment. In fact, perhaps more importantly, effective maintenance of the mechanism 100 is similarly not dependent upon the behavior of such media in light of potentially variable pressure, temperature or other downhole conditions.

Figure 3A:
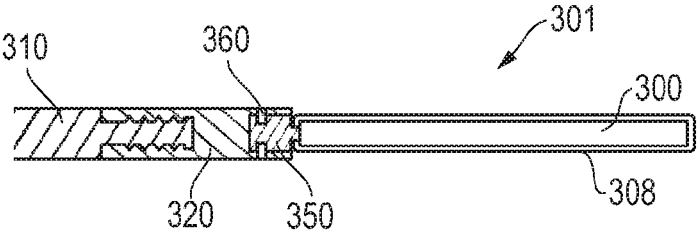
FIG. 3A is a side cross-sectional view of an alternate embodiment of mechanically deployable well isolation mechanism and associated delivery assembly.

Referring now to FIG. 3A, a side cross-sectional view of an alternate embodiment of mechanically deployable well isolation mechanism 300 and associated delivery assembly 301 is depicted. In this embodiment, a shatter housing 308 is provided as opposed to a larger delivery housing 120 (e.g. see FIG. 1A). That is, rather than extrude the mechanism 300, the shatter housing 308 is a layer of material configured to disintegrate in order to allow for deployment of the mechanism as described below.

In the embodiment of FIG. 3A, coiled tubing 310 and assembly 320 couplings are mated, with the assembly coupling 320 securing the isolation mechanism 300. More specifically, shear pins 360 are utilized to retain a head 350 of the mechanism 300. As described below, the head 350 is located at the end of a support rod 355 which runs through the mechanism 300 providing structural support (see FIG. 3B). Such support may be particularly beneficial in this embodiment due to the lack of any robust long-term housing.

Figure 3B:
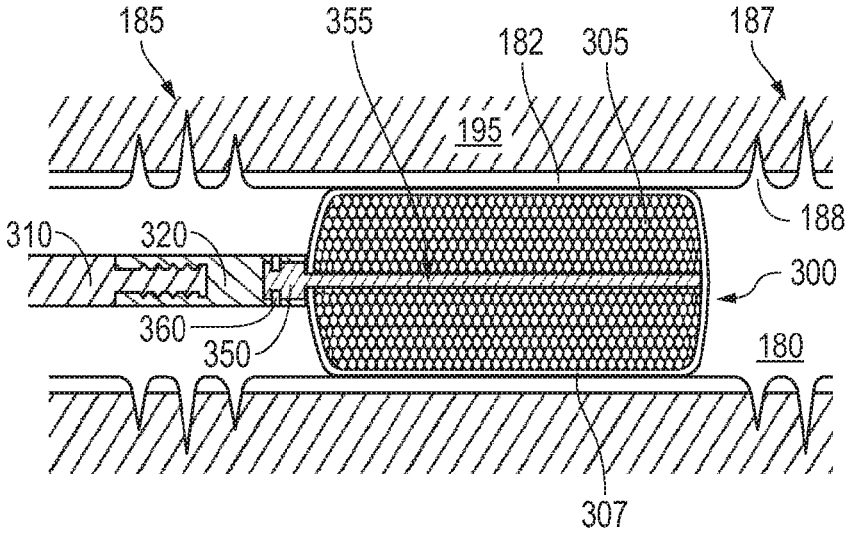
FIG. 3B is a side cross-sectional view of the mechanism and assembly of FIG. 3A at the delivery location of the well of FIG. 2.

Referring now to FIG. 3B, a side cross-sectional view of the mechanism 300 and assembly 301 of FIG. 3A are depicted at the delivery location of the well 180 of FIG. 2. As shown, the shatter housing 308 has disintegrated, thereby allowing for the expansion and deployment of the mechanism 300. That is, the mechanism 300 may again be a pre-compressed matrix material 305 encapsulated by an expandable bladder 307. As is apparent in FIGS. 3B and 3C, the matrix material 305 may be configured for mechanical self-expansion upon shattering of the housing 308, whereas the bladder 307 may again allow for such expansion and provide a sealing engagement with the well wall (i.e. at the casing 182).

The material employed for the shatter housing 308 of FIG. 3A may be a conventional polymer or other suitable material configured to disintegrate upon a certain amount of exposure to well conditions. So, for example, where positioning of the assembly 301 at the location is anticipated to take between about 30 and 45 minutes, the shatter housing 308 may be made up of a polymer known to disintegrate within about an hour's time of exposure to well conditions. While a comfortable time buffer may be utilized with such a deployment, the need for ball drop or other sophisticated actuation techniques may be avoided. Thus, non-communicative slickline deployment may be readily employed in such an embodiment. Expansion of the mechanism 300 in this embodiment may seem similar to that of a swellable packer, in that it is based on exposure to well conditions. However, the expansion ratio for the mechanism 300 is primarily based on the underlying mechanical properties of the pre-compressed matrix material 305. Thus, the expansion ratio of the mechanism 300 may be substantially larger than that of a conventional swellable packer.

Figure 3C:
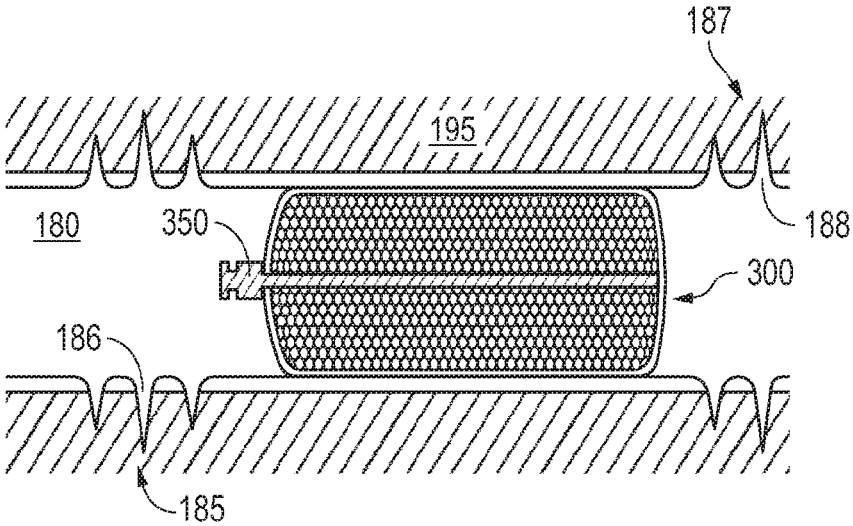
FIG. 3C is a side cross-sectional view of the mechanism of FIG. 3B deployed within the well at the location.

As alluded to above and similar to the embodiments of FIGS. 1A-1C, the expanded matrix material 305 of FIGS. 3B and 3C may be a pre-compressed foam or other suitably expansive structure. Thus, the mechanism 300 may display an expansion ratio or degree of expansion suitable for forcibly sealing a bladder 307 against the casing 182 of the well 180. As indicated above, a 1-3 inch outer diameter mechanism 300 may readily expand and conform to a 9-12 diameter casing 182 creating a sealing engagement therewith. Once more, the force of the engagement may be more than adequate for both sealing and isolating as well as physically holding the mechanism 300 in place.

Once in place, the coiled tubing 310 and assembly 320 couplings may be pulled uphole, shearing the pins 360 without dislodging of the tightly secured mechanism 300. As with the embodiments of FIGS. 1A-1C, the outer surface of the mechanism 300 is even covered with a friction enhancing substance such as solid metallic particles so as to further the anchoring in place of the deployed mechanism 300 as depicted.

In the embodiment of FIGS. 3A-3C, the presence of a fluid impermeable bladder 307 adds to the structural support of the mechanism 300 and also allows for the use of open cell foam to serve as the matrix material 305. However, closed cell foams may also be employed. Indeed, in one embodiment, the entire mechanism 300 is made up of a fluid impermeable closed cell foam for direct contact with the well wall (i.e. avoiding the use of an intervening protective bladder). Regardless, open or closed cell foams employed may be of conventional plastic, reinforced polymers and/or elastomers. Furthermore, a variety of nanocomposites and fibers may be incorporated into the matrix material 305.

In one alternate embodiment, the matrix material 305 is of an open cell foam or other porous variety without the use of a bladder 307. In this embodiment, initial structural support is provided by the rod 355 and solid particles may be incorporated into the matrix. Further, subsequent delivery of cement, sand or other appropriate fluid control substance may be provided to the mechanism 300 to allow for its sealing at the well location.

In other alternate embodiments, the shatter housing 308 is of a polymer, metal or other suitable material with a plurality of weakpoints incorporated thereinto. For example, the expansive nature of the matrix material 305 may be enhanced through exposure to well temperatures and other conditions or other factors. As a result, the weakpoints may be prone to give way, shattering the housing 308 as expansive forces are directed thereat. Such weakpoints may be cut or scored features into the surface of the housing 308. Alternatively, a wire mesh may be incorporated into the shatter housing 308 surrounding the material 305. The mesh may be configured of sufficient durability for holding the housing 308 together, but only in advance of significant exposure to downhole conditions, particularly downhole temperatures. More specifically, in the face of downhole temperatures, the mesh may act like a weakpoint mechanism with expansive forces of the matrix material 305 overcoming the ability of the mesh to hold the housing 308 together.

Figure 4A:
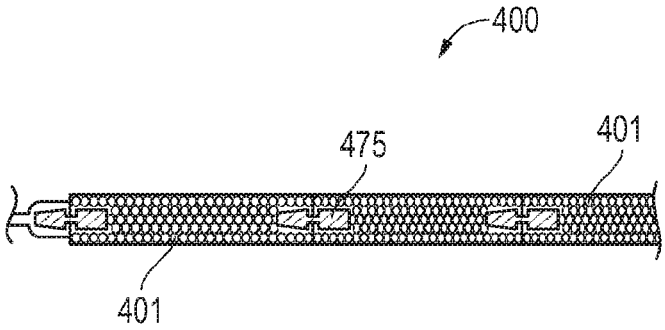
FIG. 4A is a side cross-sectional view of a linked series embodiment of mechanically deployable well isolation mechanisms in a pre-compressed state.
Figure 4B:
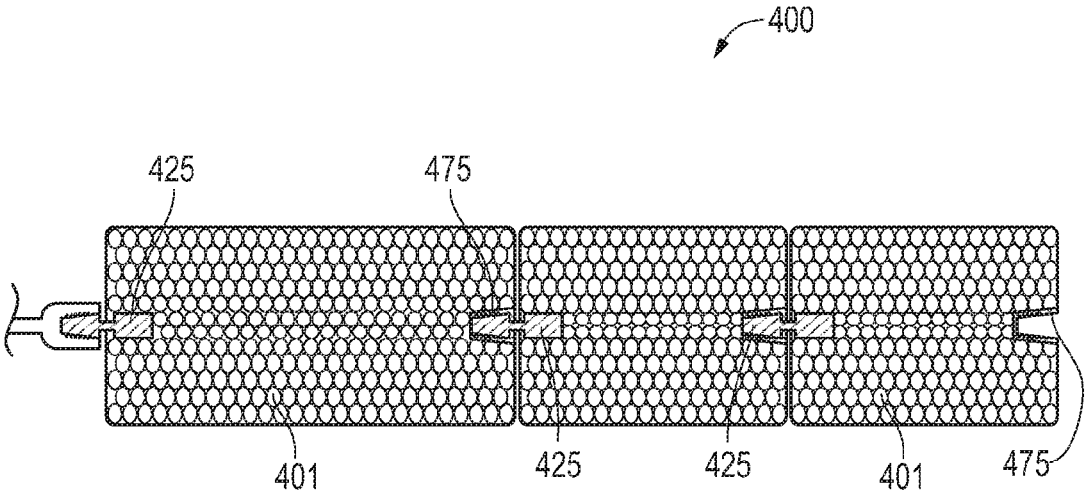
FIG. 4B is a side cross-sectional view of the mechanisms of FIG. 4A in a deployed state.

Referring now to FIGS. 4A and 4B, another alternate embodiment of mechanically deployable mechanisms 401 is depicted. More specifically, a linked series 400 of pre-compressed (FIG. 4A) and deployed (FIG. 4B) mechanisms 401 are shown. While an extrusion technique for deployment, as detailed above, may be preferred, a shatter technique may also be employed. Regardless, the linked series 400 allows for the user to custom select the effective length of isolation. That is, unlike inflation deployment of a conventional packer, the availability of extrusion and/or shatter deployment avoids the requirement that each mechanism 401 be individually inflated from surface. As a result, several off-the-shelf sized mechanisms 401, say 12-24 inches in length, may be easily linked together to allow for customizing the sealing length provided by the series 400 in the well 180. This allows for isolation of well regions of varying extended lengths without the requirement of multiple trips in the well to deliver separate spaced apart packers or mechanisms 401.

With particular reference to FIG. 4B, a closed cell matrix is provided within each mechanism 401. Thus, linkage heads 425 may be secured by the matrix. Indeed, recesses to accommodate the heads 425 in the matrix may include recess support structure 475 for maintaining a secure link with each head 425 and, by extension, each adjacent mechanism 401.

Materials for the underlying matrix may include any combination suitable for mechanical self-deployment as detailed hereinabove. Furthermore, while the embodiment of FIGS. 4A and 4B is of a closed cell matrix variety, alternate embodiments may make use of open cell matrixes with supportive rods therethrough and/or bladders about each mechanism 401. Similarly, as detailed above, such embodiments may involve the subsequent delivery of cement or other appropriate water control fluids.

Figure 5:
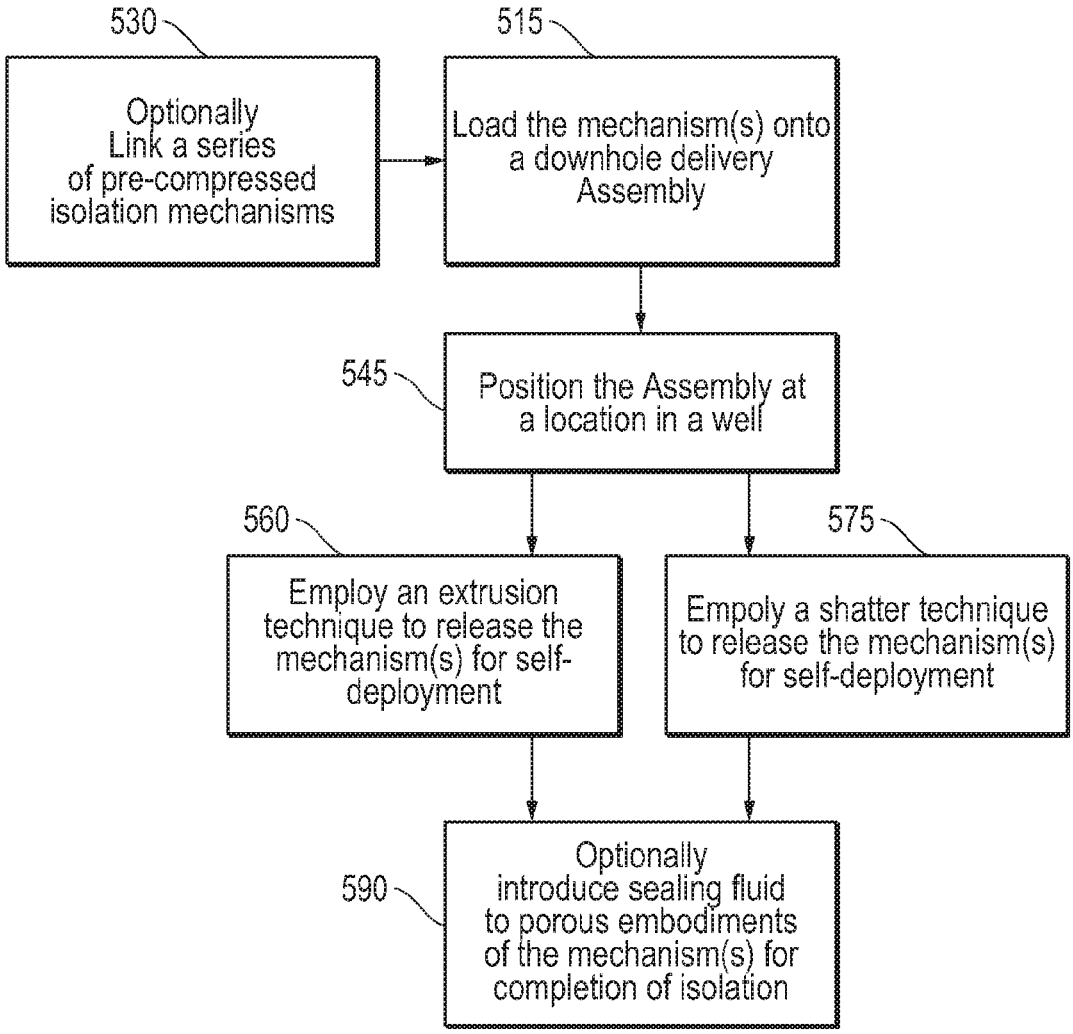
FIG. 5 is a flow-chart summarizing an embodiment of employing a mechanically deployable well isolation mechanism.

Referring now to FIG. 5, a flow-chart is provided which summarizes an embodiment of employing a mechanically deployable well isolation mechanism. As indicated at 515, the mechanism may be pre-compressed and loaded onto a downhole delivery assembly. Indeed, as detailed above and noted at 530, a whole series of isolation mechanisms may be pre-compressed, linked together, and loaded onto the assembly. The assembly may then be positioned at a location in the well where isolation is sought as indicated at 545. Once positioned, the mechanism(s) may be released for self-deployment at the location, by way of either extrusion 560 or shatter 575 techniques. Further, as indicated at 590, where open-cell or porous embodiments of the mechanisms have been utilized, a follow-on introduction of sealing fluid may be provided to complete the isolation. Nevertheless, the mechanism (s) would remain self-deployed and not reliant on such fluid for actual deployment.

Embodiments described hereinabove provide techniques for the delivery and deployment of isolation mechanisms that may serve the role of well packers. However, these mechanisms avoid the use of separately introduced inflation media in order to achieve their deployment. Thus, issues of premature inflation deployment and reliability of inflation media to maintain effective deployment are obviated. Furthermore, the number of trips in the well in order to achieve isolation may be dramatically reduced. Indeed, due to the lack of need for follow-on inflation for deployment, an entire series of mechanisms may be linked to one another to seal a substantially continuous and wide area of the well, thus reducing the likelihood of a need for follow-on delivery of subsequent mechanisms to complete the isolation.

The preceding description has been presented with reference to presently preferred embodiments. Persons skilled in the art and technology to which these embodiments pertain will appreciate that alterations and changes in the described structures and methods of operation may be practiced without meaningfully departing from the principle, and scope of these embodiments. For example, embodiments herein detail deployment of isolation mechanisms via extrusion and/or shatter techniques. However, other forms of deployment may be utilized which do not rely on the introduction of inflation media for deployment or maintenance thereof. Such techniques may include the application of heat to an underlying pre-compressed metal form of matrix. Such metals may include brass, aluminum, steel, and nano-composites. Furthermore, the foregoing description should not be read as pertaining only to the precise structures described and shown in the accompanying drawings, but rather should be read as consistent with and as support for the following claims, which are to have their fullest and fairest scope.

We claim:

1. An assembly for isolation of a downhole region of a well, the assembly comprising:

a pre-compressed mechanism configured to mechanically expand at a location in a well for engaging a wall thereof;

a retention housing to accommodate the mechanism in an interior thereof for delivery to the location; and a well access line coupled to said housing and equipment at a surface of an oilfield accommodating the well, wherein the well access line and the retention housing are each configured to release from the mechanism after delivery and expansion of the mechanism, wherein the mechanism is extruded from the interior of the housing prior to delivery and expansion thereof.

2. The assembly of claim 1 wherein said mechanism serves as one of a choke and an isolating packer relative the well during the engaging.

3. The assembly of claim 1 wherein said mechanism comprises:

a matrix material; and a fluid impermeable bladder about said matrix to interface the wall for sealing thereat during the engaging.

4. The assembly of claim 1 further comprising friction enhancing substances at an outer surface of said mechanism for enhancing stability of the engaging.

5. The assembly of claim 4 wherein said substances are metal particles.

6. The assembly of claim 1 wherein said retention housing is a cylindrical housing for extrusion of said mechanism therefrom for the delivery.

7. The assembly of claim 1 wherein said retention housing is a cylindrical housing of a shattering material configured to disintegrate and release said mechanism therefrom for the delivery.

8. The assembly of claim 1 wherein said well access line is one of coiled tubing, wireline, drill pipe, jointed pipe, and slickline.

9. A mechanically self-expanding matrix-based mechanism configured for one of a collapsed state in an interior of a housing for positioning at a well location and an expanded state external of the housing for engaging a wall of the well at the location and isolating the well downhole of the location upon self-expanding, wherein the mechanism is extruded from the interior of the housing and into the well prior to expansion and engagement, thereby enabling the mechanism to expand and engage the wall.

10. The mechanism of claim 9 comprising one of an open-cell foam and a closed-cell foam.

11. The mechanism of claim 10 wherein solid particles are incorporated into the open-cell foam.

12. The mechanism of claim 10 wherein the closed-cell foam is fluid impermeable to provide sealing at the wall during the engaging.

13. The mechanism of claim 9 wherein one of nanocomposites and fibers are incorporated into the matrix.

14. The mechanism of claim 9 further comprising a rod disposed through the mechanism for structural support thereof.

15. An assembly for isolation of a downhole region of a well, the assembly comprising:

a well delivery line for deploying into a well;

first and second retention housings attached to the well delivery line; and first and second pre-compressed material mechanisms disposed in a respective interior of the retention housings, the housings configured to extrude the mechanisms therefrom, the mechanisms configured to mechanically expand at a location in the well for engaging a wall thereof, each of the housings and the well delivery line configured to be released from the mechanisms upon expansion, wherein the mechanisms are extruded from the interior of the housings prior to delivery, expansion, and release thereof.

16. The assembly of claim 15 wherein said first and second mechanisms provide a linked device series of substantially continuous contact with the wall during the engaging.

17. The assembly of claim 15 wherein each said mechanism is of a user-selected length of between about 1 foot and about 2 feet.

18. A method comprising:

positioning a pre-compressed matrix material mechanism in an interior of a retention housing;

positioning, with a delivery line, the housing and the pre-compressed matrix material mechanism at a downhole location in a well;

extruding the mechanism from the interior of the retention housing at the location and subsequently mechanically self-expanding the mechanism to engage a wall of the well at the location and isolate the well downhole of the location; and releasing the mechanism from the delivery line and the retention housing.

19. The method of claim 18 wherein said positioning is achieved by way of coiled tubing, said releasing further comprising actuating said extruding by a ball drop technique through the coiled tubing.

20. The method of claim 18 wherein said releasing comprises shattering the housing at the location.

21. The method of claim 20 wherein said shattering comprises exposing the housing to the well environment for a known duration.

22. The method of claim 8 wherein said mechanism is of a porous character, the method further comprising introducing a fluid control substance thereto after said releasing.

23. The method of claim 22 wherein the fluid control substance is one of sand and cement.

* * * * *